US005203979A

United States Patent [19]

Üffinger et al.

[11] Patent Number: 5,203,979

[45] Date of Patent: Apr. 20, 1993

[54] SILVER RECOVERY DEVICE

[75] Inventors: Gerhard Üffinger, Weinstadt-Grossheppach; Franz-Joseph Hüttemeister, Leinfelden-Echterdingen, both of Fed. Rep. of Germany

[73] Assignee: Eastman Kodak Company, Rochester, N.Y.

[21] Appl. No.: 776,233

[22] PCT Filed: Feb. 26, 1991

[86] PCT No.: PCT/EP91/00354

§ 371 Date: Nov. 12, 1991

§ 102(e) Date: Nov. 12, 1991

[87] PCT Pub. No.: WO91/14022

PCT Pub. Date: Sep. 19, 1991

[30] Foreign Application Priority Data

Mar. 13, 1990 [DE] Fed. Rep. of Germany ..... 4007906

[51] Int. Cl.[5] ..... C25C 7/00; C25C 1/20; C25C 7/02; C25D 17/00

[52] U.S. Cl. ..... 204/272; 204/275; 204/290 R; 204/294; 204/297 R; 204/278

[58] Field of Search ..... 204/272, 275-278, 204/297 R, 290 R, 294, 109

[56] References Cited

U.S. PATENT DOCUMENTS

| | | | |
|---|---|---|---|
| 3,959,110 | 5/1976 | Burgess | 204/229 |
| 3,985,634 | 10/1976 | Larson et al. | 204/212 |
| 4,028,212 | 6/1977 | Bowen et al. | 204/272 |
| 4,069,127 | 1/1978 | Salemi et al. | 204/272 X |
| 4,149,954 | 4/1979 | Ransbottom | 204/272 |
| 4,175,026 | 11/1979 | Houseman | 204/272 |
| 4,269,690 | 5/1981 | Graham, III | 204/272 |
| 4,440,616 | 4/1984 | Houseman | 204/272 |

FOREIGN PATENT DOCUMENTS

| | | |
|---|---|---|
| 2481716 | 11/1981 | France . |
| 2077292 | 12/1981 | United Kingdom . |

*Primary Examiner*—Donald R. Valentine
*Attorney, Agent, or Firm*—L. George Legg

[57] ABSTRACT

A device for the electrolytic recovery of silver comprises a cylindrical electrolysis tank (10) made of plastic, against the inner wall surface (11*c*) of which rests an expendable cathode (30) which is formed into a hollow cylinder and consists of a sheet-type plastic carrier (31) to which a carbon sheet (32) has been applied by bonding.

In the rim areas of the tank bottom (12) and the lower side of the removable top (14), projections (13, 15) are provided which extend into the tank (10) and have inclined portions (13*a*, 15*a*) extending away from the inner wall surface (11*c*) and behind which the lower rim portion (31*a*) and the upper rim portion (31*b*) of the carrier sheet (31) of the expendable cathode (30) are held, said carrier sheet extending further than the carbon sheet (32).

At least one clamping bolt (40) of an electrically non-conductive material is passed through a circular hole in the carbon sheet (32) and an associated larger circular hole in the carrier sheet (31) and is mounted and secured in a current-carrying contact bushing (36) arranged in tank wall (11). Owing to the different size of the circular holes, an annular area (32*b*) forming part of carbon sheet (32) is clamped between the head (40*a*) of clamping bolt (40) and the end face (36*b*) of contact bushing (36), which is located in the area of the inner wall surface (11*c*), and the cathode (30) is thus contacted and additionally held on the inner wall surface (11*c*). When the clamping bolt (40) is removed in the direction of the arrow, head (40*a*), which is shaped like a trunkated cone, can be easily separated from the silver layer (52) deposited on the cathode.

23 Claims, 7 Drawing Sheets

SILVER RECOVERY DEVICE

Figure 1:
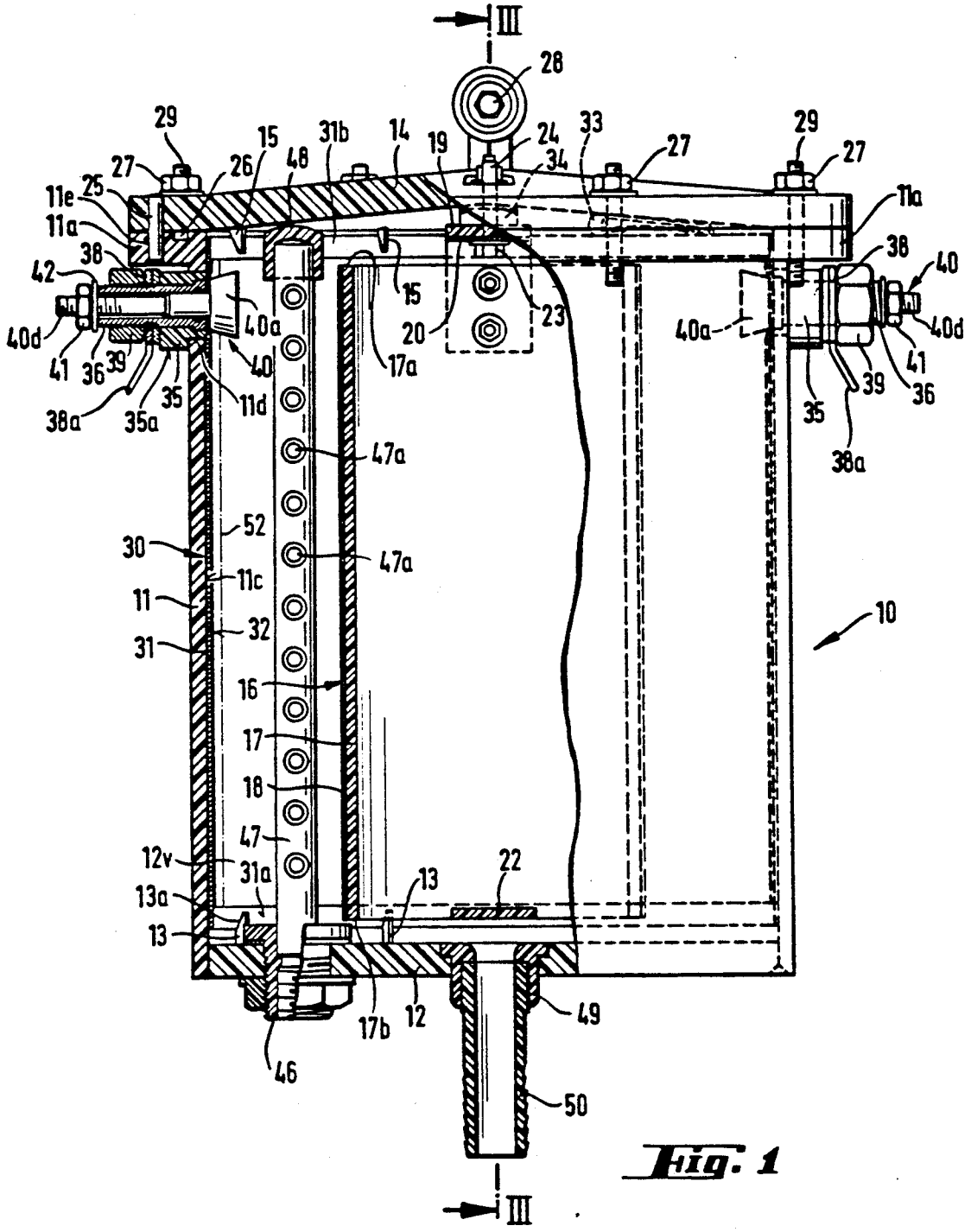

The invention relates to a device for the electrolytic recovery of silver from a photographic processing liquid, said device comprising a cylindrical electrolysis tank having at its bottom a liquid inlet and a liquid outlet as well as a hollow-cylindrical anode, which is arranged concentrically within said cylindrical tank, and an expendable cathode, which is formed into a hollow cylinder, rests against the inner surface of the tank wall and consists of a sheet carrier which is provided with an electrically conductive layer on the surface facing the anode, and also having electrical contacts for the cathode and the anode.

U.S. Pat. No. 4,028,212 discloses a silver recovery device which in one of its embodiments comprises a hollow cylindrical plastic electrolysis tank whose top is provided with an air vent. The cathode which is made of a strip of stainless steel is formed into a hollow cylinder. It is outwardly spring urged in the tank so as to rest against the inner surface of the tank wall. At the upper rim of the cathode, an angular portion is arranged which is electrically connected with the power supply via a screw screwed through the top. A hollow cylinder provided with a cover extends across a liquid inlet opening disposed in the center of the tank bottom. It serves as a carrier for a carbon anode which surrounds the hollow cylinder. In its wall, a number of jet tubes are uniformly distributed across the circumference of the wall surface and passed through the peripheral wall of the carbon anode. During electrolytic silver deposition the photographic processing liquid enters the hollow cylinder through the inlet opening and flows through the jet tubes into the space between the anode and the cathode which rests against the inner surface of the tank wall, before it flows out again through a discharge opening disposed in the tank bottom between anode and cathode.

Since the hollow cylinder, which is provided with jets and associated with the liquid inlet opening, also serves as a carrier for the anode, the complete assembly group including the anode has to be removed when a jet is clogged, for example. During such an operation the anode may be damaged. All jets have to be removed for cleaning. If an electrolytic silver deposition has been completed in this known silver recovery device the hollow-cylindrically shaped cathode can be removed from the open tank, bent open, scraped and used again. This operation is complicated, time-consuming and difficult because the bent-off contact tongue of the angular portion as well as the end of the screw which is connected with the electrical lead and contacts the contact tongue must be carefully cleaned. Moreover, much skill is required for seizing the cathode and removing it from the tank.

According to another embodiment of this known silver recovery device an expendable cathode is also provided which consists of a plastic strip in the form of a hollow cylinder which has an electrically conductive coating.

In order that this expandable plastic cathode can spring outwardly and fit as snugly into the inner surface of the tank wall as a hollow-cylindrical cathode consisting of a thin-walled resilient steel sheet it must be produced from a thicker, highly resilient and thus expensive plastic material. Since a fresh expendable plastic cathode must be used for each electrolytic silver deposition the use of such expendable cathodes is very expensive. Moreover it is difficult and complicated to seize the silvercoated expendable cathode and remove it from the tank.

If a thin plastic sheet carrying the electrically conductive layer were used instead of such an expendable cathode it would be no problem to mold such sheet into a hollow cylinder. However, the spring force by which it would be urged against the inner surface of the tank wall would be too low. During electrolytic silver deposition the sheet cathode resting against the inner surface of the tank wall might become indented and and be displaced so that perfect silver recovery would no longer be ensured. It might even be possible for the bent-off contact tongue of the angular portion fixed to the cathode to slide off the screw end of the screw connected with the electrical lead so that the electrolytic silver deposition would be interrupted.

U.S. Pat. No. 3,985,634 discloses an expendable cathode which consists of a thin plastic sheet provided with a thin silver coating and taking the form of a hollow cylinder. It is also given a hollowcylindrical shape and inserted into a cylindrical electrolysis tank which is provided with a motor-driven anode arrangement rotating in its center. It is in that point where the expendable cathode rests against the inner surface of the tank wall. An angular portion arranged at the lower side of the tank top and connected with an electrical lead extends with its bent-off contact tongue into the recess of a clamping device inserted into the tank wall. In the area of the upper rim of the cathode, the clamping device passes between the facing end edges of the cathode which rests against the inner surface of the tank wall and is formed into a hollow cylinder. At that point of the cathode, the facing end edges thereof are clamped together jointly with the contact tongue by means of a clamping screw.

This clamping device, which is adapted to ensure contact between the contact tongue and the cathode, can also assit in holding the cathode on the inner surface of the tank wall. However, this holding at one point only is completely inadequate for the hollow-cylindrical cathode which may consist of a carrier sheet of a thickness of no more than about 0.25 mm, the more so as the force by which the cathode is spring-urged against the inner surface of the tank wall is extremely low. During an electrolytic silver deposition the rim area of the cathode opposite to the clamping device can be displaced by the weight of the silver deposited and the sheet may become inwardly curved and indented.

Moreover, extreme care is required in order to prevent the end edges of the cathode, which face each other in the area of the tank bottom, from sliding into each other so that the hollowcylindrical cathode assumes a conical shape in the direction towards the bottom.

In addition, when the silver has been deposited, the contact tongue is enclosed by the deposited silver such that when the tank top is removed after the clamping screw has been released to disengage the contact tongue from the cathode, it is difficult to separate the contact tongue from the silver-coated cathode. Parts of the silver deposited in the direct vicinity of the contact tongue on the cathode can come off. And, as in the case of the previously mentioned silver recovery device, it is very complicated to seize the cathode and remove it from the tank.

It is the object of the invention to provide a silver recovery device of the generic type in which an expendable cathode, which consists of a thin plastic sheet formed into a hollow cylinder and provided with an electrically conductive coating, can easily be inserted into the electrolysis tank and in which the lower and the upper circumferential rims are accurately guided so that the cathode fits snugly against the inner surface of the tank wall and is held in that position. Moreover, reliable contact-making of the cathode is to be ensured, with the means for making contact with the cathode being removable without problem when the cathode is exchanged, without parts of the silver layer coming off which are deposited in particular in the area of said contact means. The silver coated cathode which weighs several kilograms should be removable from the tank without difficulties and the anode and a liquid inlet provided with jets should be separately exchangeable.

In accordance with the invention this object is attained in that holding means provided within the electrolysis tank serve to engage and hold the lower and upper circumferential rims of the cathode resting against the inner surface of the tank wall and in that at least one clamping bolt made of an electrically nonconductive material is provided which is passed through a circular hole disposed in the electrically conductive layer and through another circular hole which is associated with the first hole and provided in the carrier sheet of the cathode, said clamping bolt being mounted and secured in a contact bushing arranged in the tank and connected with an electrical lead, and in that the clamping bolt both connects the electrically conductive layer of the cathode with the current-carrying contact bushing and secures the cathode against displacement along the inner surface of the tank wall.

According to an advantageous modification of the invention the holding means consist of projections molded at the rims of the bottom and the top and resting against the inner surface of the tank wall, said projections extending into the interior of the tank and being provided each with inclined surface which extends at an acute angle away from the inner surface of the tank wall.

According to a further advantageous modification the holding means consist of beads continuous around the rims of the bottom and the top and resting against the inner surface of the tank wall, said beads projecting into the interior of the tank and each having an inclined surface which extends at an acute angle away from the inner surface of the tank wall.

According to still another advantageous modification two clamping bolts consisting of an electrically nonconductive material are provided which are passed through two opposite circular holes in the electrically conductive layer of the cathode and through two further circular holes associated with the first holes and provided in the carrier sheet of the cathode, said clamping bolts being mounted and secured in two oppositely arranged contact bushings which are disposed in the tank wall and connected with electrical leads.

Further features and advantages can be inferred from the subclaims as well as from the description of an embodiment illustrated in the drawings.

In the drawing

Figure 2:
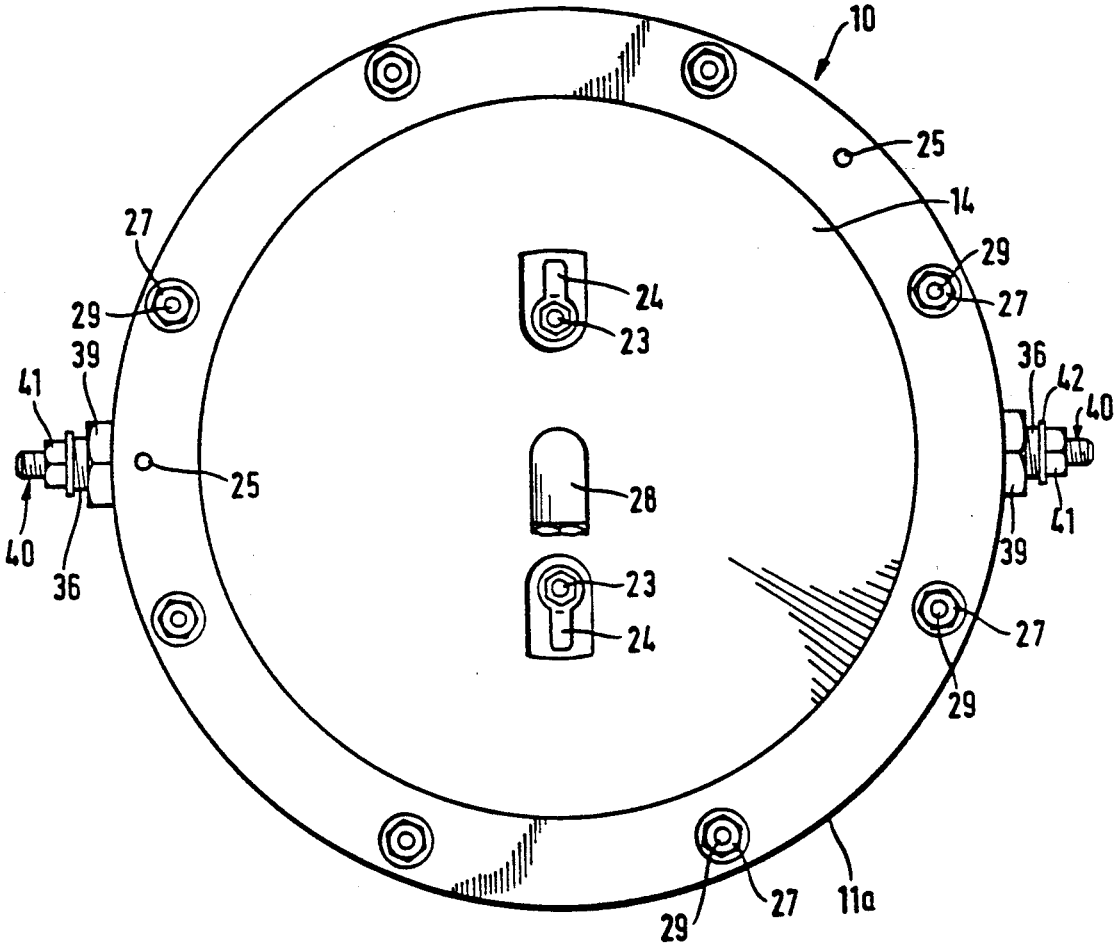
Figure 3:
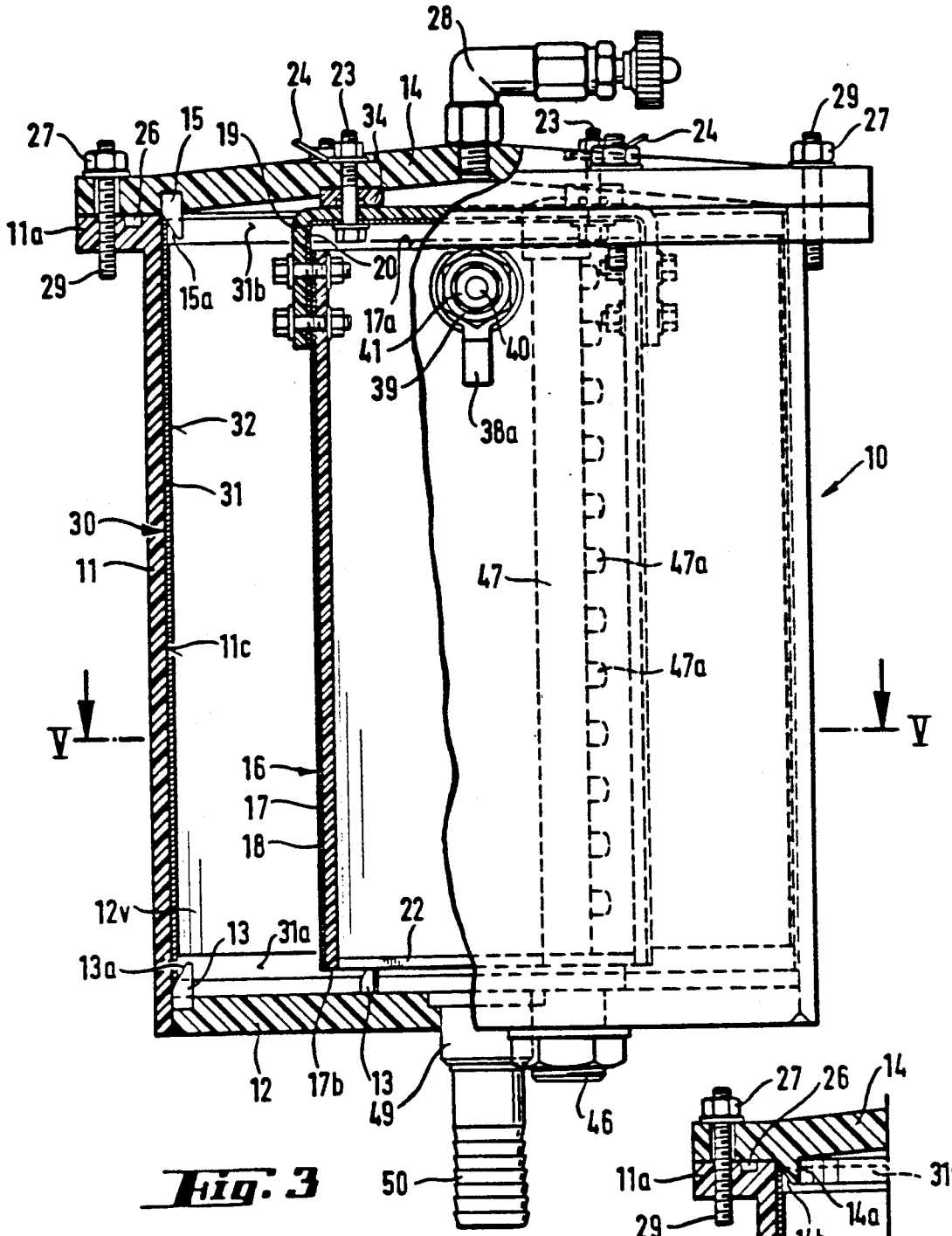
Figure 4:
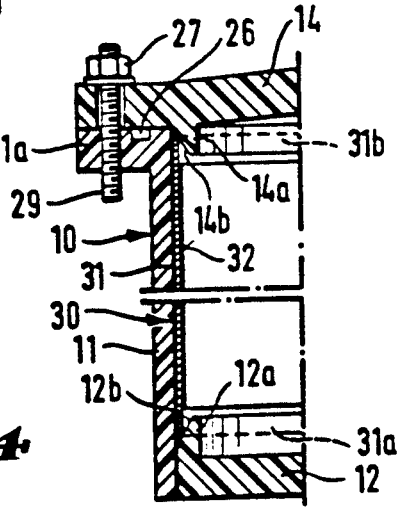
Figure 5:
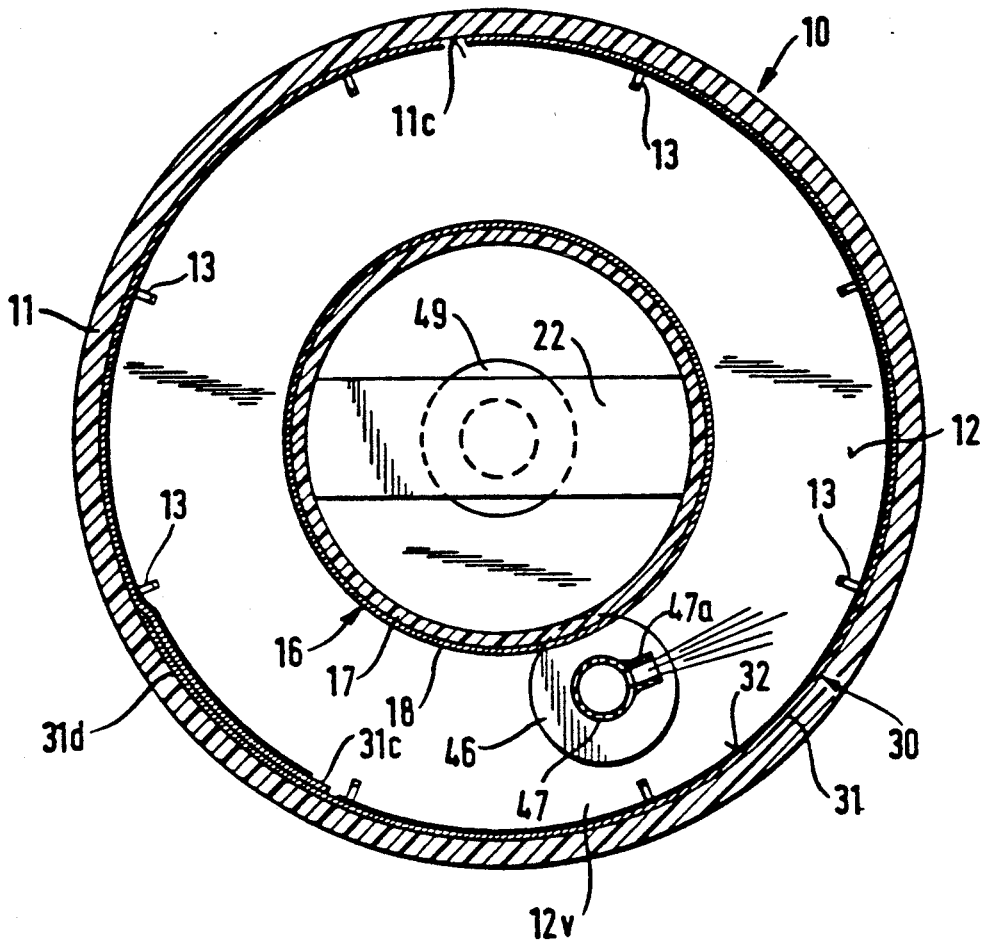
Figure 6:
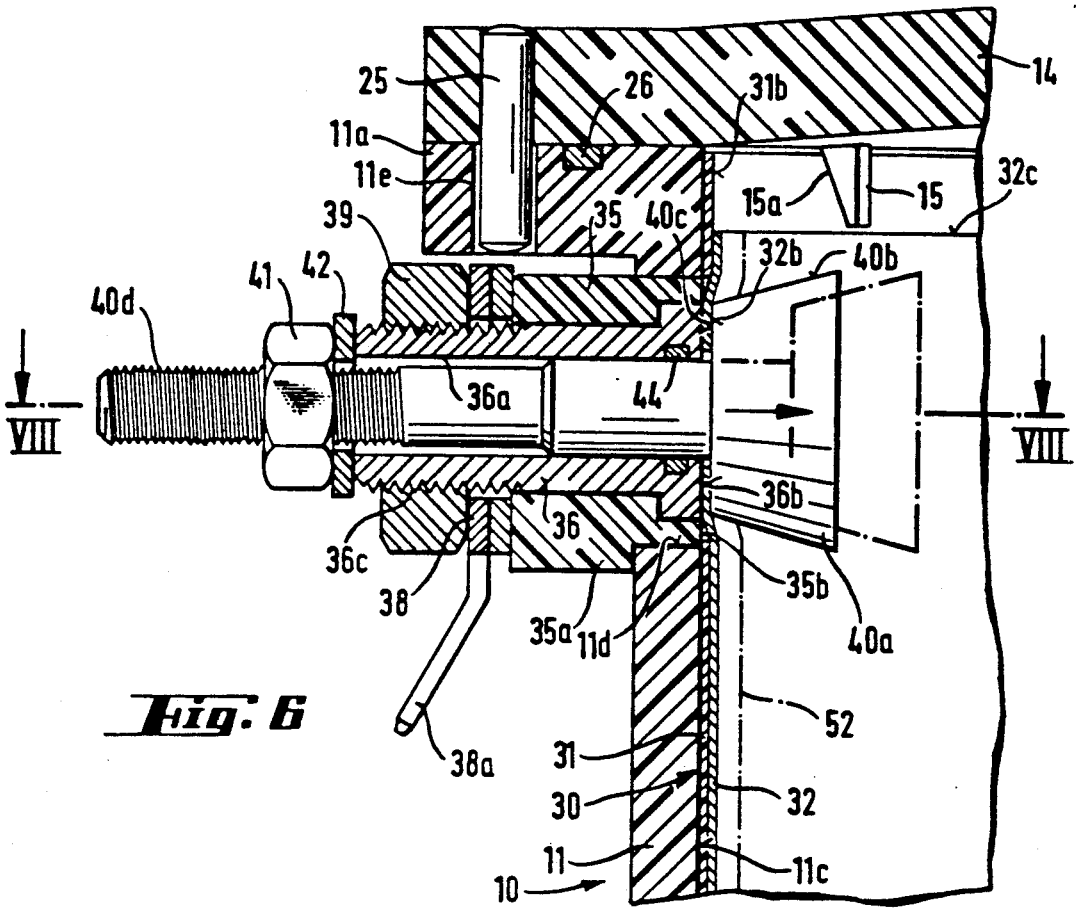
Figure 7:
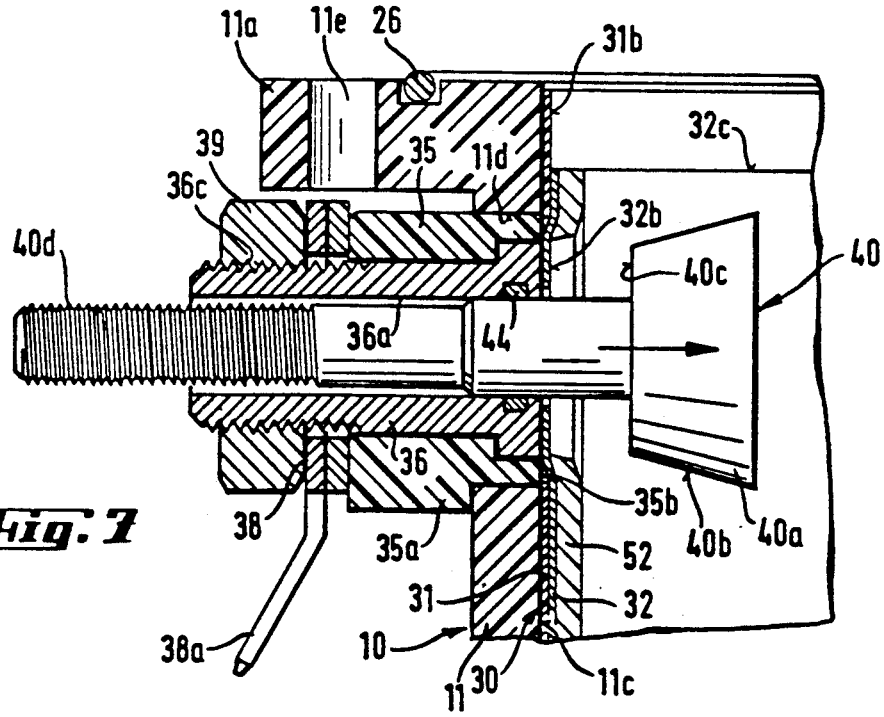
Figure 8:
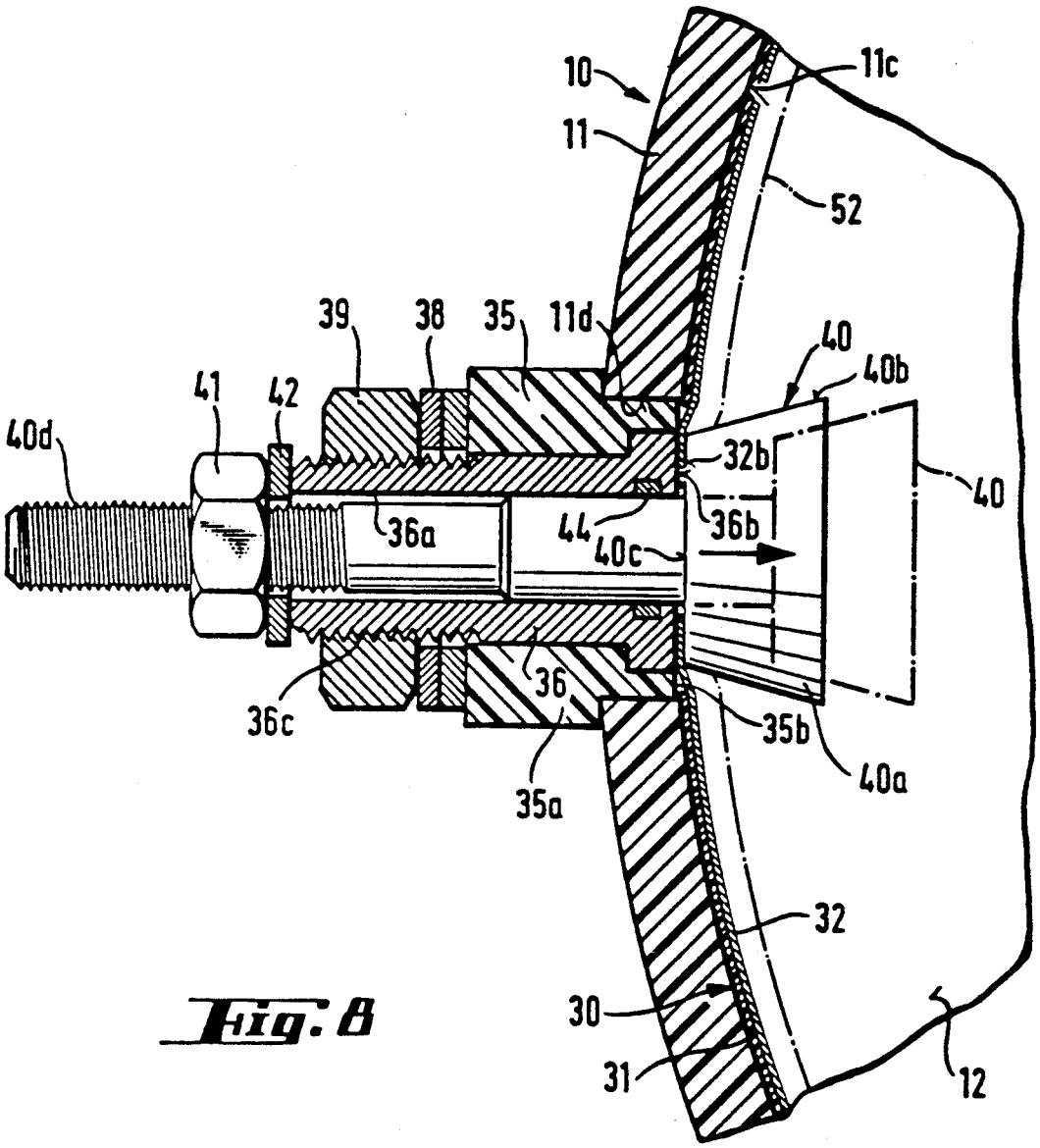
Figure 9:
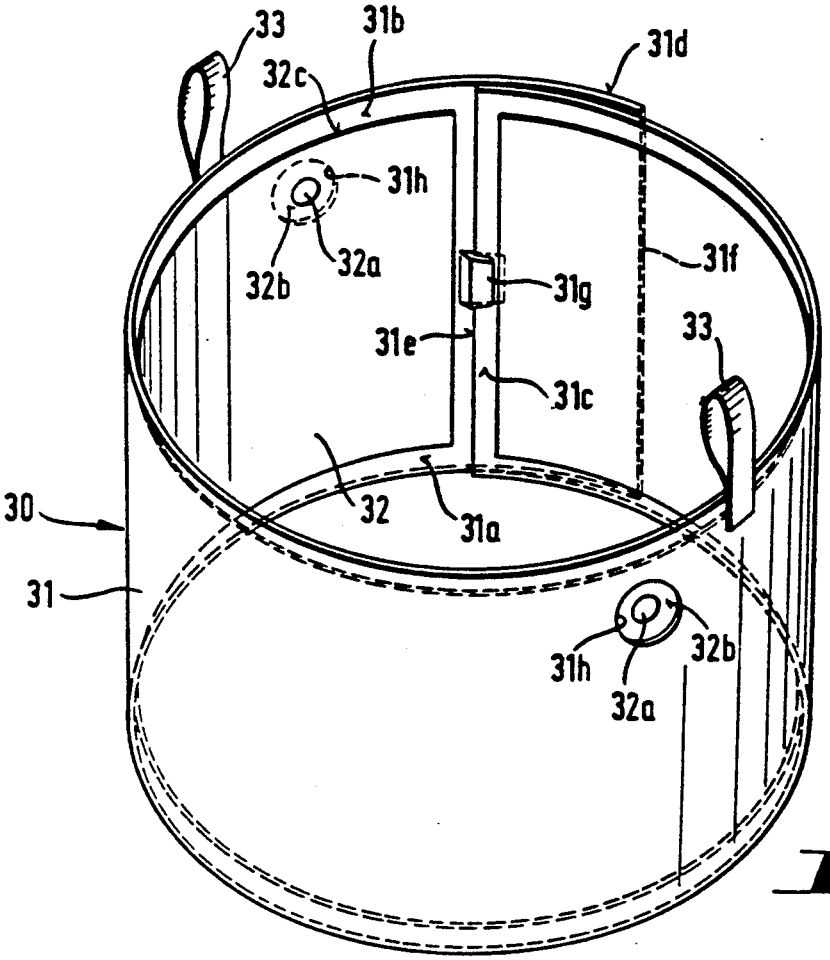
Figure 11:
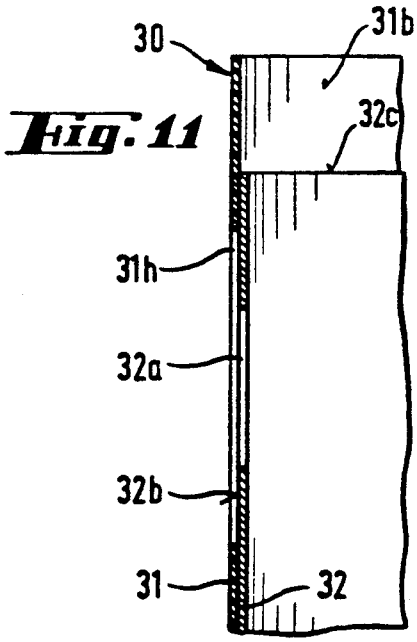
Figure 10:
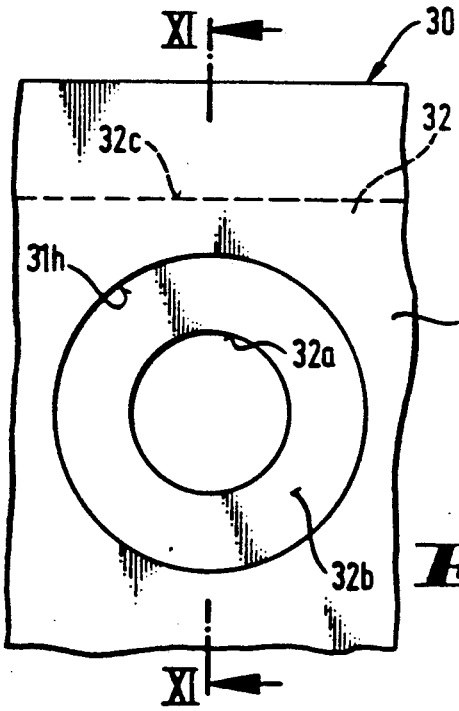

FIG. 1 is a lateral view, partially in section, of the silver recovery device according to the invention including holding means for the cathode and contact means, FIG. 2 is a plan view of the device according to FIG. 1, FIG. 3 is a sectional view taken along line III—III of the device of FIG. 1, FIG. 4 is a sectional view of a detail of the device including another embodiment of the holding means for the cathode and taken along line III—III of FIG. 1, FIG. 5 is a sectional view of the device taken along line V—V of FIG. 3, FIG. 6 is an enlarged sectional view of the contacting means according to FIG. 1, FIG. 7 is a view of another functional position of the contacting means according to FIG. 6, FIG. 8 is a sectional view of the contacting means taken along line VIII—VIII of FIG. 6, FIG. 9 is a perspective view of the cathode of the silver recovery device, FIG. 10 is a front view of a detail of the cathode according to FIG. 9, and FIG. 11 is a sectional view of a detail of the cathode taken along line XI—XI of FIG. 10.

FIGS. 1, 2, 3 and 6 show the most important components of the silver recovery device. A cylindrical electrolysis tank generally denoted 10, which consists of plastic material, comprises a stationary bottom plate 12 and a removable top 14. The upper end of the tank wall 11 is provided with a circumferential rim 11*a* which projects from said wall at right angles and in whose support surface a gasket ring 26 is inserted. Top 14 which is slightly conically shaped towards its upper end is arranged on said support surface.

Threaded pins 29 are screwed through the rim 11*a* of tank wall 11, said pins passing through holes in the rim of the top and projecting from the upper top surface. Nuts 27 are screwed onto the projecting parts of the threaded pins 29 for fastening the top 14. Moreover, two pins 25 pressed into the rim of the top extend into two holes 11*e* located in the rim 11*a*. Thanks to the arrangement of the pins 25 and the holes 11*e*, top 14 can be arranged in always the same position on tank 10 (FIG. 2). An air vent 28 is screwed into the apex of the cone of top 14. As a result of the conical shape of top 14, tank 10 can be filled with silver-containing fixing solution almost up to its upper rim.

Projections 13 are provided in the area of the rim of bottom 12 and projections 15 in the area of the rim of the lower side of top 14, said projections extending into tank 10 and resting against the inner surface 11*c* of tank wall 11. All of the projections 13 and 15 are provided with inclined portions 13*a* and 15*a* which extend at an angle of about 30° away from the inner surface 11*c* of tank wall 11. The projections serve as means for holding an expendable cathode 30 formed into a cylinder on the inner surface 11*c* of tank wall 11. As shown in FIG. 4, the projections 13 and 15 can also be replaced by beads 12*a* and 14*a* continuous about the rims of bottom 12 and top 14 and extending into the interior of tank 10 where they rest against the inner surface 11*c* of tank wall 11; each of such beads is provided with a circumferential inclined surface 12*b* and 14*b* extending at an acute angle of about 30° away from the inner surface 11*c* of tank wall 11.

The expendable cathode 30 will now be described in more detail with reference to FIGS. 9 to 11. The cathode consists of a thin carrier sheet 31, made of plastic such as Estar, and of a thinwalled carbon sheet 32 bonded to said carrier sheet and forming an electrically conductive layer. The carbon sheet 32 which has a thickness of about 0.3 mm is of smaller dimensions than the carrier sheet 31 which has also a thickness of 0.3 mm at maximum. The carbon sheet 32 is bonded to the carrier sheet 31 such that the latter extends beyond the carbon sheet 32 on all sides.

As can be inferred from FIG. 9, when cathode 30 has been formed into a hollow cylinder carbon sheet 32 is located on the inner surface of carrier sheet 31, and carrier sheet 31, which extends beyond carbon sheet 32, forms a lower and an upper circumferential rim portion 31*a* and 31*b*.

As also shown in FIG. 9, a tongue 31*g* obtained by means of three cuts is provided in the area of a broader rim portion 31*d* of the carrier sheet 31, said rim portion overlapping one end of the carbon sheet 32. A narrower rim portion 31*c* which projects from the other end of the carbon sheet 32 is inserted behind tongue 31*g* when cathode 30 is formed into a hollow cylinder. The tongue 31*g* is spaced from the edge 31*f* of the broader rim portion 31*d* such that the edge 31*e* of the narrower rim portion 31*c* is positioned adjacent to the carbon sheet 32 and the carrier sheet 31 and the rim portions 31*d*, 31*e* respectively overlap to some extent. Moreover two oppositely located holding loops 33 are attached to the outer surface of the upper rim portion of the carrier sheet 31. When silver has been deposited on cathode 30 the cathode can be removed from the tank using these holding loops 33.

According to the embodiment two smaller circular holes 32*a* (FIGS. 9 and 10) are provided in the area of the upper rim 32*c* of carbon sheet 32, which lie opposite to each other in the case of the cathode taking the form of a hollow cylinder. Each of these two smaller circular holes 32*a* in carbon sheet 32 is associated with a larger circular hole 31*h* in the carrier sheet 31. Since the smaller circular holes 32*a* are substantially concentrical with the larger circular holes 31*h*, annular areas 32*b* are created which are part of the carbon sheet 31 and extend inwardly from the edges of the larger circular holes 31*h* of the carrier sheet 31.

As can be seen in particular in FIGS. 1 and 6, two opposite bores 11*d* are provided in the area of the upper circumferential rim 11*a* of tank wall 11, into which bores receiving bushings 35 made of plastic are inserted by pressing and/or bonding. The bushings have flanges 35*a* projecting from the outer surface of the tank wall 11. The receiving bushings 35 may also form an integral unit with tank wall 11.

Contact bushings 36 made of stainless steel are mounted by bonding in the two receiving bushings 35. They each comprise a threaded shank 36*c* which projects from the flange 35*a* of each receiving bushing 35 and on which a contact disk 38 provided with a tab connector 38*a* is screwed by means of a nut 39.

When cathode 30 has been formed into a hollow cylinder and fitted together at its ends as shown in FIG. 9 and is inserted into tank 10, care has only to be taken that the circular holes 32*a* of the carbon sheet 32 bonded onto the carrier sheet 31 of cathode 30 are substantially flush with the bores 36*a* (FIGS. 6 and 8) of the contact bushings 36 and that the lower circumferential rim portion 31*a* of carrier sheet 31 is brought into a position behind the inclined portions 13*a* of the projections 13 (FIG. 3) disposed in the rim area of bottom 12 or behind the circumferential inclined surface 12*b* (FIG. 4) if a circumferential bead 12*a* is used on the rim of bottom 12. The inclined portions 13*a* and the circumferential inclined surface 12*b* respectively serve both as an aid to inserting cathode 30 and for clamping the lower rim of carrier sheet 31 of cathode 30 when the cathode comes to rest against the inner surface 11*c* of tank wall 11.

In the present embodiment, two clamping bolts 40 (FIGS. 1 and 6) are provided as contact means for cathode 30. The clamping bolts consist of plastic and each have a threaded shank 40*d* and a head 40*a* shaped like a circular trunkated cone. The peripheral surface 40*b* of head 40*a* tapers conically in the direction towards threaded shank 40*d*.

Each of the two clamping bolts 40 is passed from the inner side of the hollow cylindrical cathode 30 through the circular holes 32*a* in the carbon sheet 32 and through the contact bushings 36 arranged in tank wall 11. As can be readily seen from FIG. 6, a gasket ring 44 is additionally provided in the wall of each bore 36*a* of the two contact bushings 36. By means of a nut 41 with an associated washer 42, which is screwed onto each clamping bolt's threaded shank 40*d* which extends outwardly from the contact bushing 36, the clamping bolts 40 are secured in the contact bushings 36. The annular areas 32*b* which are part of the carbon sheet 32 are thereby clamped between the end faces 36*b* of the contact bushings 36 and the faces 40*c* of the heads 40*a*, facing the threaded shank 40*d*, of the clamping bolts 40 secured in the contact bushings 36. As can be seen from FIG. 8, the end faces 35*b* of the receiving bushings 35, which face the cathode 30, and the end faces 36*b* of the contact bushings 36 are almost flush with the curved inner surface 11*c* of tank wall 11.

When top 14 is placed on tank 10 and screwed onto its rim 11*a*, the projections 15 and the bead 14*a* respectively, which were described before, are placed on the rim of the inner side of the top directly in front of the upper circumferential rim portion 31*b* of the carrier sheet 31 of cathode 30, which extends further than the carbon sheet 32, and keep said rim portion against the inner surface 11*c* of tank wall 11. Moreover the clamping bolts 40, which serve as contact means for cathode 30, are also used, as described before, for additionally holding cathode 30 and securing it against displacement along the inner surface 11*c* of tank wall 11.

As shown in FIGS. 1, 3 and 5, anode 16 consists of a carbon sheet 18 which is applied to the outer surface of a thin-walled hollow cylinder 17 made of plastic. The hollow cylinder 17 is screwed onto a bracket 19 mounted on the lower side of top 14. The bracket is held by two screws 23 which project from the upper side of top 14 and onto the projecting ends of which one tab connector 24 each is screwed (FIGS. 2 and 3) such that a positive cable of the electrical power supply can be connected. Bracket 19 extends across the upper rim 17*a* of the hollow cylinder 17 surrounded by the carbon sheet 18. Between carbon sheet 18 and the inner side of bracket 19, a contact sheet 20 is located which acts as a conductor in that it connects the carbon sheet 18 and the current-carrying attachment screws 23. Hollow cylinder 17 is concentrical with the cathode 30, which rests against the inner surface 11*c* of tank wall 11, and terminates at a small distance above tank bottom 12. At its lower circumferential rim 17*b*, a cross piece 22 is provided which is secured to two opposite rim sections of hollow cylinder 17.

A liquid-discharge pipe 49 provided with a hose liner 50 is arranged in the center of bottom 12 and a liquid-supply pipe 46 at any point of the area 12*v* of bottom 12 between anode 16 and cathode 30 (FIG. 5). An upright closed tube 47 having a jet 47*a* and being closed by a cover 48 (FIG. 1) is inserted in the liquid-supply pipe 46.

By means of the jets 47*a* the silver-containing photographic processing liquid introduced via liquid-supply pipe 46 from the tank of a film processing and fixing system is maximally accelerated so that during an electrolytic silver deposition, the processing liquid contained in tank 10 between anode 16 and cathode 30 is vigorously agitated.

During such operation fresh processing liquid to be desilvered is continuously supplied to the active surface of the carbon sheet 32 provided on the cathode and facing the anode 16.

When after a certain period of time an electrolytic silver deposition cycle has terminated, the processing liquid is discharged so that cathode 30 can be exchanged, and after the attachment nuts 27 have been released, top 14 is lifted along with anode 16 attached to it. Subsequently the nuts 41 and the washers 42 are removed form the clamping bolts 40 and the clamping bolts are pushed inwardly in the direction of the arrow and withdrawn from the contact bushings 36 as shown in FIG. 7.

Since the heads 40*a* of the clamping bolts 40 are shaped like circular trunkated cones and their peripheral surfaces 40*b* are conically tapered in the direction towards the threaded shank 40*d* and thus towards the carbon sheet 32 of cathode 30, heads 40*a* can be removed without problem from a cathode 30 coated with a thick silver layer 52 when the clamping bolts 40 are shifted in and there is no danger of parts of the silver 52 coming off, which is deposited on the cathode 30 in the immediate vicinity of the heads 40*a*. When the heads 40*a* have reached the position shown in FIG. 7 they can be easily seized and removed by hand. Finally, as was described above, the holding loops 33 allow the cathode 30 to be removed from the tank 10 and a new cathode formed into a hollow cylinder to be inserted.

We claim:

1. Device for the electrolytic recovery of silver from a photographic processing liquid, said device comprising a cylindrical electrolysis tank having at its bottom a liquid inlet and a liquid outlet as well as a hollow-cylindrical anode, which is arranged concentrically within the cylindrical tank, and an expendable cathode, which is formed into a hollow cylinder, rests against the inner surface of the tank wall and comprises a sheet carrier which is provided with an electrically conductive layer on a surface facing the anode, and also having electrical contacts for the cathode and the anode, characterized in that holding means (12*a*, 14*a*; 13, 15) provided within the electrolysis tank (10) serve to engage and hold the lower and upper circumferential rims of the cathode (30) resting against the inner surface (11*c*) of tank wall (11) and in that at least one clamping bolt (40) of an electrically nonconductive material is provided which is passed through a circular hole (32*a*) disposed in the electrically conductive layer (32) and through another circular hole (31*h*) which is associated with hole (32*a*) and disposed in the carrier sheet (31) of cathode (30), said clamping bolt being mounted and secured in a contact bushing (36) arranged in tank wall (11) and connected with an electrical lead, and in that clamping bolt (40) both connects the electrically conductive layer (32) of cathode (30) with the current-carrying contact bushing (36) and secures the cathode (30) against displacement along the inner surface (11*c*) of tank wall.

2. Device according to claim 1, characterized in that the holding means comprises projections (13, 15) which are molded to the rims of bottom (12) and top (14) and rest against the inner surface (11*c*) of tank wall (11) and which project into the interior of the tank (10), each of said projections being provided with an inclined portion (13*a*, 15*a*) extending at an acute angle away from the inner surface (11*c*) of tank wall (11).

3. Device according to claim 1, characterized in that the holding means comprises beads (12*a*, 14*a*) continuous around the rims of bottom (12) and top (14), resting against the inner surface (11*c*) of tank wall (11) and projecting into the interior of tank (10) and in that each bead (12*a*, 14*a*) is provided with an inclined circumferential surface (12*b*, 14*b*) which extends at an acute angle away from the inner surface (11*c*) of tank wall (11).

4. Device according to claim 1, characterized in that two clamping bolts (40) consisting of an electrically nonconductive material are passed through two oppositely arranged circular holes (32*a*) in the electrically conductive layer (32) of cathode (30) and through two further circular holes (31*h*) associated with the holes (32*a*) and provided in the carrier sheet (31) of cathode (30), said clamping bolts being mounted and secured in two contact bushings (36) arranged oppositely to each other in the tank wall (11) and connected with electrical leads.

5. Device according to claim 4, characterized in that the contact bushings (36) comprise a threaded shank (36*c*) which projects from the flange (35*a*) of the receiving bushings (35) and onto which a contact disk (38) provided with a tab connector (38*a*) is screwed.

6. Device according to claim 4, characterized in that the contact bushings (36) comprise stainless steel and are inserted by bonding into plastic receiving bushings (35), in that the receiving bushings (35) are pressed into bores (11*d*) oppositely arranged in the area of the upper circumferential rim (11*a*) of tank wall (11) and in that they have flanges (35*a*) which project from the outer surface of tank wall (11).

7. Device according to claim 6, characterized in that the contact bushings (36) comprise a threaded shank (36*c*) which projects from the flange (35*a*) of the receiving bushings (35) and onto which a contact disk (38) provided with a tab connector (38*a*) is screwed.

8. Device according to claims 4, 5, 6, or 7, characterized in that the end faces (35*b* and 36*b*) of the receiving bushings (35) and the contact bushings (36), which face the cathode (30), are almost flush with the inner surface (11*c*) of the tank wall (11).

9. Device according to claim 8, characterized in that each of the clamping bolts (40) has a threaded shank (40*d*) and a conical head (40*a*) whose circumferential surface (40*b*) tapers conically in the direction towards the threaded shank (40*d*) and in that when cathode (30) is inserted into tank (10), the annular areas (32*b*) are clamped between the end faces (36*b*) of the contact bushings (36) and the surfaces (40*c*), facing the threaded shanks (40*d*), of the heads (40*a*) of the clamping bolts (40) secured within contact bushings (36).

10. Device according to claims 1 or 4, characterized in that the two circular holes (32*a*) in carbon sheet (32) are smaller than the circular holes (31*h*) of carrier sheet (31) which are concentrically associated with said holes such that annular areas (32*b*) are formed.

11. Device according to claim 10, characterized in that each of the clamping bolts (40) has a threaded shank (40*d*) and a conical head (40*a*) whose circumferential surface (40*b*) tapers conically in the direction towards the threaded shank (40*d*) and in that when cathode (30) is inserted into tank (10), the annular areas (32*b*) are clamped between the end faces (36*b*) of the contact bushings (36) and the surfaces (40*c*), facing the threaded shanks (40*d*), of the heads (40*a*) of the clamping bolts (40) secured within contact bushings (36).

12. Device according to claim 1, characterized in that the electrically conductive layer arranged on the carrier sheet (31) consists of a thin carbon sheet (32) bonded onto the carrier sheet (31) and having a smaller surface area than the carrier sheet (31), said carbon sheet being disposed on the inner surface of the carrier sheet (31) in the case of cathode (30) having been formed into a hollow cylinder.

13. Device according to claim 12, characterized in that the carbon sheet (32) is bonded adhesively to the carrier sheet (31) such that the latter extends beyond the carbon sheet (32) on all sides and in that in the case of cathode (30) having been formed into a hollow cylinder, the carrier sheet (31) extending from the carbon sheet (32) forms a lower and an upper circumferential rim portion (31*a* and 31*b*).

14. Device according to claim 13, characterized in that in the area of a broader rim portion (31*d*) of carrier sheet (31), which extends at one end from the carbon sheet (32), at least one tongue (31*g*) is cut out behind which a narrower rim portion (31*c*) of carrier sheet (31), which extends from the other end of carbon sheet (32), is inserted in the case of cathode (30) having been formed into a hollow cylinder.

15. Device according to any of claims 1 or 12 to 12, characterized in that the cathode (30) when formed into a hollow cylinder comprises two oppositely arranged holding loops (33) which are secured to the outer surface of the upper rim of the carrier sheet (31).

16. Device according to claims 4, 12 or 13, characterized in that the two oppositely arranged circular holes (32*a*) are provided in the area of the upper rim (32*c*) of carbon sheet (32).

17. Device according to claim 16, characterized in that the two circular holes (32*a*) in carbon sheet (32) are smaller than the circular holes (31*h*) of carrier sheet (31) which are concentrically associated with said holes such that annular areas (32*b*) are formed.

18. Device according to claims 1, 4, 5, 7, or 10, characterized in that each of the clamping bolts (40) has a threaded shank (40*d*) and a conical heed (40*a*) whose circumferential surface (40*b*) tapers conically in the direction towards the threaded shank (40*d*) and in that when cathode (30) is inserted into tank (10), the annular areas (32*b*) are clamped between the end faces (36*b*) of the contact bushings (36) and the surfaces (40*c*), facing the threaded shanks (40*d*), of the heads (40*a*) of the clamping bolts (40) secured within contact bushings (36).

19. Device according to claim 1, characterized in that the hollow-cylindrical anode (16) arranged in tank (10) comprises a carbon sheet (18) which is applied to the outer surface of a thin-walled hollow cylinder (17) and in that the hollow cylinder (17) is screwed to a bracket (19) connected to the lower side of top (14) and terminates closely above bottom (12).

20. Device according to claim 17, characterized in that the bracket (19) is secured by means of two screws (23) which extend from the upper side of top (14) and on the projecting ends of which a tab connector (24) is mounted for the electric power supply.

21. Device according to claims 19 or 20, characterized in that the bracket (19) extends around the upper rim of the hollow cylinder (17) surrounded by the carbon sheet (18) and in that a contact sheet (20) is provided which extends between the carbon sheet (18) and the inner side of bracket (19) and acts as a conductor which connects the carbon sheet (18) and the current-carrying mounting screws (23).

22. Device according to claim 19, characterized in that the top (14) is conically shaped and that an air vent (28) is provided on the apex of the cone, said air vent being screwed into top (14).

23. Device according to claim 19, characterized in that in the bottom of tank (10), a liquid exit pipe (49) is associated with a liquid supply pipe (46) which is arranged at any point of the area of the bottom (12) between anode (16) and cathode (30) and in that an upright pipe (47) closed at the top and equipped with jets (47*a*) is inserted into the liquid supply pipe (46).

* * * * *